US009315878B2

(12) United States Patent
Valerio

(10) Patent No.: US 9,315,878 B2
(45) Date of Patent: Apr. 19, 2016

(54) SYSTEM AND METHOD FOR IRON ORE BYPRODUCT PROCESSING

(71) Applicant: Thomas A. Valerio, New Port Richey, FL (US)

(72) Inventor: Thomas A. Valerio, New Port Richey, FL (US)

( * ) Notice: Subject to any disclaimer, the term of this patent is extended or adjusted under 35 U.S.C. 154(b) by 0 days.

(21) Appl. No.: 14/024,120

(22) Filed: Sep. 11, 2013

(65) Prior Publication Data

US 2014/0077008 A1 Mar. 20, 2014

Related U.S. Application Data

(60) Provisional application No. 61/701,265, filed on Sep. 14, 2012.

(51) Int. Cl.

| | |
|---|---|
| ***B03B 9/00*** | (2006.01) |
| ***C22B 1/24*** | (2006.01) |
| ***B07B 9/00*** | (2006.01) |
| ***B07B 11/02*** | (2006.01) |
| ***B02C 19/00*** | (2006.01) |
| ***C22B 1/00*** | (2006.01) |
| ***B07B 9/02*** | (2006.01) |
| ***B03B 9/04*** | (2006.01) |
| *B03B 4/02* | (2006.01) |
| *B07B 4/08* | (2006.01) |

(52) U.S. Cl.

CPC ..... *C22B 1/24* (2013.01); *B02C 19/0056* (2013.01); *B03B 9/04* (2013.01); *B07B 9/00* (2013.01); *B07B 9/02* (2013.01); *B07B 11/02* (2013.01); *C22B 1/00* (2013.01); *B03B 4/02* (2013.01); *B07B 4/08* (2013.01)

(58) Field of Classification Search

CPC ..... B07B 9/00; B07B 11/02; B07B 4/08; B02C 17/1835; B02C 17/184; B02C 19/0056; B03B 4/00; B03B 4/02; B03B 9/00; B03B 9/04

USPC ..... 209/19, 30, 33, 35, 44, 458, 471; 241/24.1, 79

See application file for complete search history.

(56) References Cited

U.S. PATENT DOCUMENTS

| | | | | |
|---|---|---|---|---|
| 3,905,556 | A * | 9/1975 | Drage | 241/19 |
| 4,416,768 | A * | 11/1983 | Nosseir | 241/20 |
| 5,462,172 | A * | 10/1995 | Kumagai et al. | 209/12.1 |
| 6,074,456 | A * | 6/2000 | Freytag et al. | 75/436 |
| 6,138,833 | A * | 10/2000 | Matsufuji et al. | 209/10 |
| 6,340,378 | B1 * | 1/2002 | Hinrichsen | 75/436 |
| 6,355,088 | B1 * | 3/2002 | Greenwalt | 75/436 |
| 7,786,401 | B2 * | 8/2010 | Valerio | 209/571 |
| 8,066,794 | B2 * | 11/2011 | Liubakka et al. | 75/10.13 |
| 8,360,347 | B2 * | 1/2013 | Valerio | 241/19 |
| 8,673,208 | B2 * | 3/2014 | Bueno Colina | 266/114 |
| 2008/0257794 | A1 * | 10/2008 | Valerio | 209/567 |
| 2012/0199676 | A1 * | 8/2012 | Valerio | 241/19 |

* cited by examiner

*Primary Examiner* — Joseph C Rodriguez

(74) *Attorney, Agent, or Firm* — Nigamnarayan Acharya; Baker Donelson

(57) ABSTRACT

Processing byproduct material from a direct reduction process of iron ore to reclaim iron and other materials from the byproduct. The systems and methods employ gravity separation tables to separate the iron from other byproduct material constituents. The byproduct material constituents may be size reduced, processed to remove dust, and sized prior to processing by the gravity separation.

19 Claims, 2 Drawing Sheets

SYSTEM AND METHOD FOR IRON ORE BYPRODUCT PROCESSING

CROSS-REFERENCE TO RELATED APPLICATIONS

This non-provisional patent application claims priority under 35 U.S.C. §119 to U.S. Provisional Patent Application No. 61/701,265, titled "Iron Byproduct Processing," filed Sep. 14, 2012. The complete disclosure of this provisional patent application is hereby fully incorporated herein by reference.

TECHNICAL FIELD

The present invention generally relates to processing byproducts of iron ore reduction processes and, more particularly, processing a byproduct of an iron ore direct reduction process to provide a remaining composition of matter comprising iron in greater proportion than in the byproduct. The iron ore reduction process may include, but not limited to, the processing of hematite, taconite, magnetite, laterite, goethite or other iron bonded mineral.

BACKGROUND OF THE INVENTION

Iron ore is an important natural resource and iron may be the world's most commonly used metal. Iron may be extracted from iron ore and used in a variety of commercial and industrial applications, including the manufacture of steel. Typically, iron extraction from iron ore results in certain byproducts that still include some remaining iron. These byproducts are generally considered waste, especially if the iron cannot be economically extracted from the slag.

Iron is generally extracted from iron ore rocks that contain enough metallic iron for economical extraction. The iron in iron ore is generally found in the form of magnetite, hematite, taconite, goethite, limonite, and siderite, for example. Iron ore is mainly made of iron ore oxides carrying different quantities of iron. For instance, based on the respective atomic numbers of iron (Fe)—55.84—and oxygen (O)—15.994—we see that a typical iron ore molecule of $Fe_2O_3$ carries close to 70% of iron by weight. One main use of iron ore having high iron content (e.g. greater than about 60%), is to produce "pig iron." Pig iron, a main material used to make steel, is an intermediate product resulting from the reduction of the iron ore through the smelting of iron ore with a carbon fuel such as coke, charcoal, and anthracite. Pig iron is mainly made of iron with a high carbon content residue of the reduction process. Pig iron is commonly processed in and poured directly from a blast furnace for transfer to a steel mill. It is noted that, while iron ore may be a suitable feed for blast furnaces of integrated steel mills, the iron ore is not suitable for the minimills of the steel industry, which commonly rely on electric arc furnaces to produce steel. Instead, the minimills require to be fed with higher iron content material like pig iron and steel scrap. In steel processing, for example, pig iron from blast furnaces is used to produce steel, usually with an electric arc, induction, or oxygen furnace, by burning off excess carbon and adding certain metal alloys.

As an alternative to processing (reducing) iron ore in a blast furnace to produce pig iron, new technologies have been developed to process iron ore by direct reduction to produce iron nuggets or pellets suitable as a substitute for pig iron in minimill steel production. For example, new direct reduction processes have achieved the production of metallic iron nuggets having a metallic iron content greater than 90%, sometimes as high as 97%, using iron ore as feed. These iron nuggets are well suited for use in electric arc furnaces in place of pig iron.

The direct reduction techniques replaces the work of certain processing plants and sometimes eliminates the need for coke ovens. The process generates less emissions, less energy, and offers lower overall costs than traditional processes for the generation of pig iron. The direct reduction process is more energy efficient than the blast furnace because it operates at a lower temperature, and there are several other factors that make the direct reduction process economical. In certain direct reduction techniques, iron ore nuggets are produced in a rotary hearth furnace using a feed of iron ore (in the form of lumps, pellets, or fines) using a reducing gas produced from natural gas or coal. The reducing gas is a mixture majority of hydrogen and carbon monoxide which acts as a reducing agent.

Conventional byproduct processing techniques have relied upon magnets to further extract iron from processing byproducts, since iron is magnetic. However, for the byproducts of direct reduction techniques, magnetic separation has been found relatively ineffective. For example, certain non-ferrous elements in the byproducts may have been magnetized through the reduction process, making the magnetic separation of these byproducts less desirable as the resulting product will include these impurities. Also the possible significant quantity of iron in the byproducts of a direct reduction technique increases the likelihood that non-ferrous elements will get trapped between the iron particles as they attach to the magnetic surface, also reducing the iron purity of the output.

The byproducts of direct reduction, however, have proven to be difficult to process, especially using conventional magnetic techniques, although still containing valuable elements such as iron and anthracite, for example. Examples of direct reduction byproducts include "iron fines" mixed with dust. Iron fines include particles having a size of 15 mm or less consisting of iron slag and anthracite, for example. The iron fine byproduct may consist of about 60% or less metallic iron. The byproducts of direct reduction may also include iron slag consisting of about 10% or less magnetic iron, without (or with less) dust or anthracite, for example, and "revert," which is a byproduct consisting of a combination of coke, iron slag, and anthracite.

What is needed is a process to recover iron from an iron byproduct, to reduce the amount of waste from mining and reduction operations, and to provide a valuable resource for the economy. Further, it is preferable that the recovery process is a dry process, as iron is prone to oxidize (rust) in the presence of water.

SUMMARY OF THE INVENTION

The present invention provides cost-effective, efficient methods and systems for extracting iron from the byproduct of an iron ore direct reduction process.

One aspect of the present invention provides a method for separating iron from a byproduct material of a direct reduction process of iron ore. The method includes the steps of: 1) receiving the byproduct material of a direct reduction process of iron ore; 2) processing the byproduct material using an air aspirator to generate a heavy fraction byproduct material and a light fraction byproduct material; 3) sizing the heavy fraction byproduct material from the air aspirator, wherein the particles of the sized heavy fraction byproduct material are within a discrete size range; and 4) separating an iron fraction from the sized heavy fraction byproduct material using a gravity separation table.

Another aspect of the present invention provides a system for separating iron from a byproduct material of a direct reduction process of iron ore. The system includes a source of the byproduct material of a direct reduction process of iron ore; an air aspirator for processing the byproduct material to generate a heavy fraction byproduct material and a light fraction byproduct material; a screen for sizing the heavy fraction byproduct material from the air aspirator, wherein the particles of the sized heavy fraction byproduct material are within a discrete size range; and a gravity separation table for separating an iron fraction from the sized heavy fraction byproduct material using.

DETAILED DESCRIPTION OF EXEMPLARY EMBODIMENTS

Exemplary embodiments of the present invention provide systems and methods for processing a byproduct of an iron ore direct reduction process to provide a remaining composition of matter comprising iron in greater proportion than in the byproduct.

Figure 1:
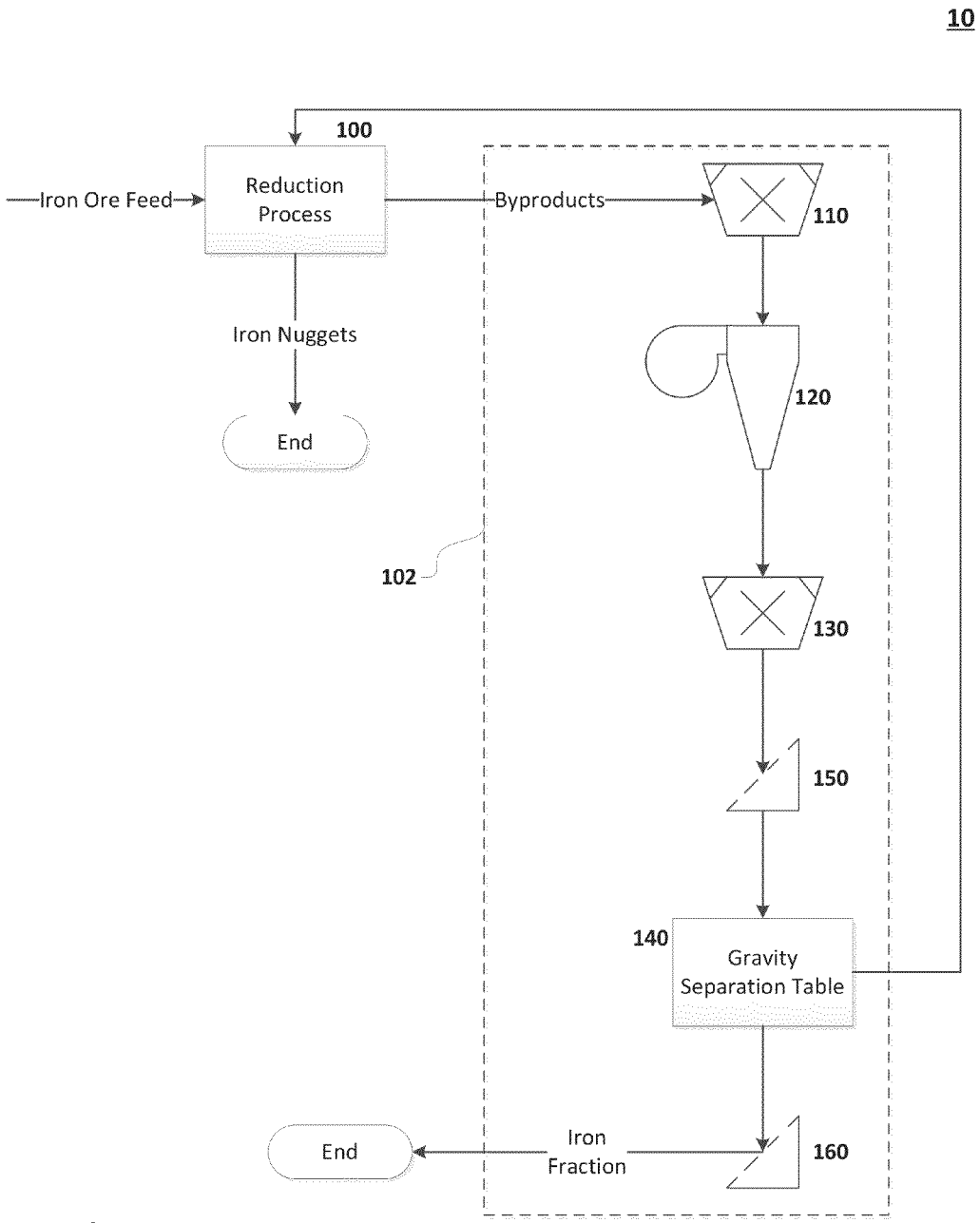
FIG. 1 illustrates an example equipment layout diagram for iron byproduct processing system according to an exemplary embodiment of the present invention.

FIG. 1 illustrates an example equipment layout diagram 10 for iron byproduct processing according to certain embodiments. Referring to FIG. 1, a reduction process 100, such as an iron ore direct reduction process, is illustrated. Iron ore is fed into the reduction process 100 and iron nuggets are output. The byproducts of the reduction process 100 are provided to a byproduct processing system 102. In this exemplary embodiment, the byproduct processing system 102 includes one or more size reducers 110 and 130, one or more aspirators 120, and one or more vacuum or pressure gravity separation tables 140, as well as one or more sizing screens 150 which may be added prior or after to the aspirators 120 or gravity separation tables 140.

From the one or more separation tables 140, separated iron, at an iron content of 90% or greater, is output. Additionally, other separated elements, such as anthracite, are output and may be provided back to the reduction process as fuel, for example.

It is noted that, depending upon the type of byproduct from the reduction process 100, the byproduct processing system 102 may or may not rely upon or include the use of certain equipment, such as the size reducers 110 and 130. For example, the processed byproduct may not require any size reducing before being introduced into the aspirator 120 and/or the gravity separation table 140.

At first, depending upon the grade and sizing of the iron fines, iron slag, and revert byproducts, the byproducts from the reduction process 100 may be crushed using the size reducer 110. The size reducer 110 may comprise a vertical impact crusher or similar equipment known in the art and is generally relied upon to reduce the sizing of byproduct particles. Other examples of size reducers 110 include jaw crushers, cone crushers, and hammer mills. As noted above, the size reducer 110 may be omitted in certain embodiments. In this exemplary embodiment, the byproducts from the reduction process are reduced to a size of 6 mm or smaller. By reducing the size of the byproducts from the reduction process, the chances of having pieces of iron entrapped in the byproduct material is greatly reduced. In some cases, the size reducer may be omitted depending on the specific mineral of interest. For example, the value of anthracite in the revert byproducts is reduced if the anthracite is pulverized. After the size reducer 110, the byproduct is then provided to the one or more aspirators 120.

The one or more aspirators 120 remove dust from the byproduct stream. An exemplary aspirator 120 is an air aspirator. Air aspirators generally offer a low noise, low cost, and low maintenance solution to dust removal. There are different types of air aspirators, including shallow box aspirators, deep box aspirators, cone aspirators, Z-box, B-box. Each of these exemplary air aspirators are air gravity classifiers, which are generally made of a chamber that allows material to enter into an air stream that flows countercurrent from the material flow. Light material in the material feed stream is swept into the air stream and separated from the heavier particles in the byproduct feed stream. The air aspirators generate two product streams—a light fraction, which will include the dust particles, and a heavy fraction, which will include the byproduct material stream with the dust particles removed.

In certain embodiments, an additional size reducer 130 may be used depending upon the grade and sizing of the output from the aspirators 120. The performance of the gravity separation tables 140, which receives the material after the aspirators 120, is optimized for particles that are uniform in size and 6 mm or less in size. The size reducer 130 may be similar to the size reducer 110. Alternatively, the size reducer 130 may be a different type of size reducer or operate at a different rate or speed than the size reducer 110. Additionally, because size reducing, such as by crushing, may create dust, an additional stage of aspirators, similar to the one or more aspirators 120, may be relied upon after the size reducer 130, as necessary. Dust is removed to prevent clogging of any remaining equipment, such as the gravity separation tables 140, in the byproduct processing system 102.

Sizing screens 150 ensure that the byproduct material further processed in the byproduct processing system 102 is within a certain size range and additionally provide a finished product such as iron nuggets that failed to be recover on the reduction process 100. In an exemplary embodiment, the sizing screens 150 may segregate the material into two sizes: greater than 6 mm or less than or equal to 6 mm. Iron nuggets that inadvertently passed into the byproduct stream would most likely be in the size range of greater than 6 mm. This size range may be processed, such as by a drum magnet, to recover the iron nuggets. In an alternative embodiment, the sizing screens 150 may segregate the materials into finer ranges, such as 0-2 mm, 2-4 mm, 4-6 mm, and greater than 6 mm. After the dust has been removed and the byproduct stream has been sufficiently sized in the sizing screens 150, byproduct stream (that is, the "heavy fraction" from the aspirators) is fed into one or more vacuum or pressure gravity separation tables 140. In the alternative embodiment with discrete size ranges of, for example, 0-2 mm, 2-4 mm, 4-6 mm, and greater than 6 mm, each size range is fed into the gravity separation tables 140 separately (or each size range into its own gravity separation table 140).

The determination of whether to screen the material into finer such ranges, for example, 0-2 mm, 2-4 mm, 4-6 mm, and greater than 6 mm, may depend on the make-up of the material being process. For example, if the process is separating anthracite from slag, two components with very similar specific gravities, then the finer sizing may be useful. However, if processing fines, the iron component has a much higher (over three times) specific gravity than anthracite, coal or slag, which may reduce the need for finer size categories.

A gravity separation table includes a vibrating, screen-covered deck that is positioned on an incline, such that the deck slopes down in one direction. Granular material, such as the byproduct material, is introduced onto the deck as it vibrates. The screen of the deck allows air to flow up from beneath the deck. This air flow causes light components of the processed material to float over the surface of the deck in a stratified mass. The heavier components of the processed material remain close to or on the deck. The vibration and air flow actions cause the lighter strata to move down the inclined deck of the gravity separation table while the heavy strata move up the incline. In this way, a heavy fraction of the material can be collected at the upper end of the inclined deck while a light fraction can be collected at the lower end of the inclined deck.

The gravity separation tables 140 may be a pressure-type or vacuum-type design. A pressure-type gravity separation table pushes air up through the screen of the deck, creating a positive pressure over the deck. This is accomplished such as by positioning a fan under the deck structure of the gravity separation table. Typically, the pressure-type gravity separation table has an open deck. A vacuum-type gravity separation table creates a vacuum over the deck, creating a suction that pulls air through the screen of the deck. A vacuum-type gravity separation table is enclosed with an air source downstream of the gravity separation table deck.

Vacuum and pressure gravity separation tables generally offer long service life and fast and reliable performance. Separator tables, such as the vacuum or pressure gravity separation tables 140, may be generally adjusted for deck vibration speed, air flow, pressure, suction, feed elevation, and pitch, for example, to separate particles on the basis of different specific gravities within certain ranges. By placement of dividers on the tables 140, particles having different specific gravities can be separated from lightest to heaviest. The gravity separation tables 140 permit a complete and accurate density classification from the very lightest to the very heaviest of particles in the feed material stream, such as the byproduct material. For example, among the byproduct material elements of the direct reduction process, the specific gravity of iron ranges from about 7.0 to 7.7 (i.e., greater than 7), the specific gravity of anthracite ranges from about 1.1 to 1.6, and the specific gravity of iron slag ranges from about 1.2 to 2.1.

To achieve the desired separation by the gravity separation tables 140, the air flow rate through the screen of the table deck is adjusted until the heavy fraction and light fraction have the different constituents of interest. Other aspects of the gravity separation tables 140 are adjusted, both to fine tune the separation and to keep the separation operation stable throughout the process. For example, the frequency and amplitude of the vibrations of the deck can be adjusted. Also, the inclination of the deck can be adjusted (typically and indicatively from 5 degrees to 25 degrees). Additionally, the material being separated should be fed onto the gravity separation tables 140 deck in a consistent and constant manner to maintain the stability of the separation process.

Because separator tables are able to effectively separate particles having specific gravities of one unit of measure difference, for example, good separation between iron, with a specific gravity of greater than 7, and anthracite, with a specific gravity from about 1.1 to 1.6, is possible with the vacuum or pressure gravity separation tables 140. Based on the difference in specific gravity among the elements in the byproduct material provided to the gravity separation tables 140, the byproduct material processed in the gravity separation tables 140 can be separated to provide separate iron, anthracite, and slag fractions, for example. The iron fraction may be fed back into the direct reduction process 100 or, because of its high iron content of about 90% iron or greater, the iron may be used directly for steel production. Additionally, the anthracite fraction may be fed back to the reduction process 100 as a fuel. The slag fraction is typically considered waste.

Figure 2:
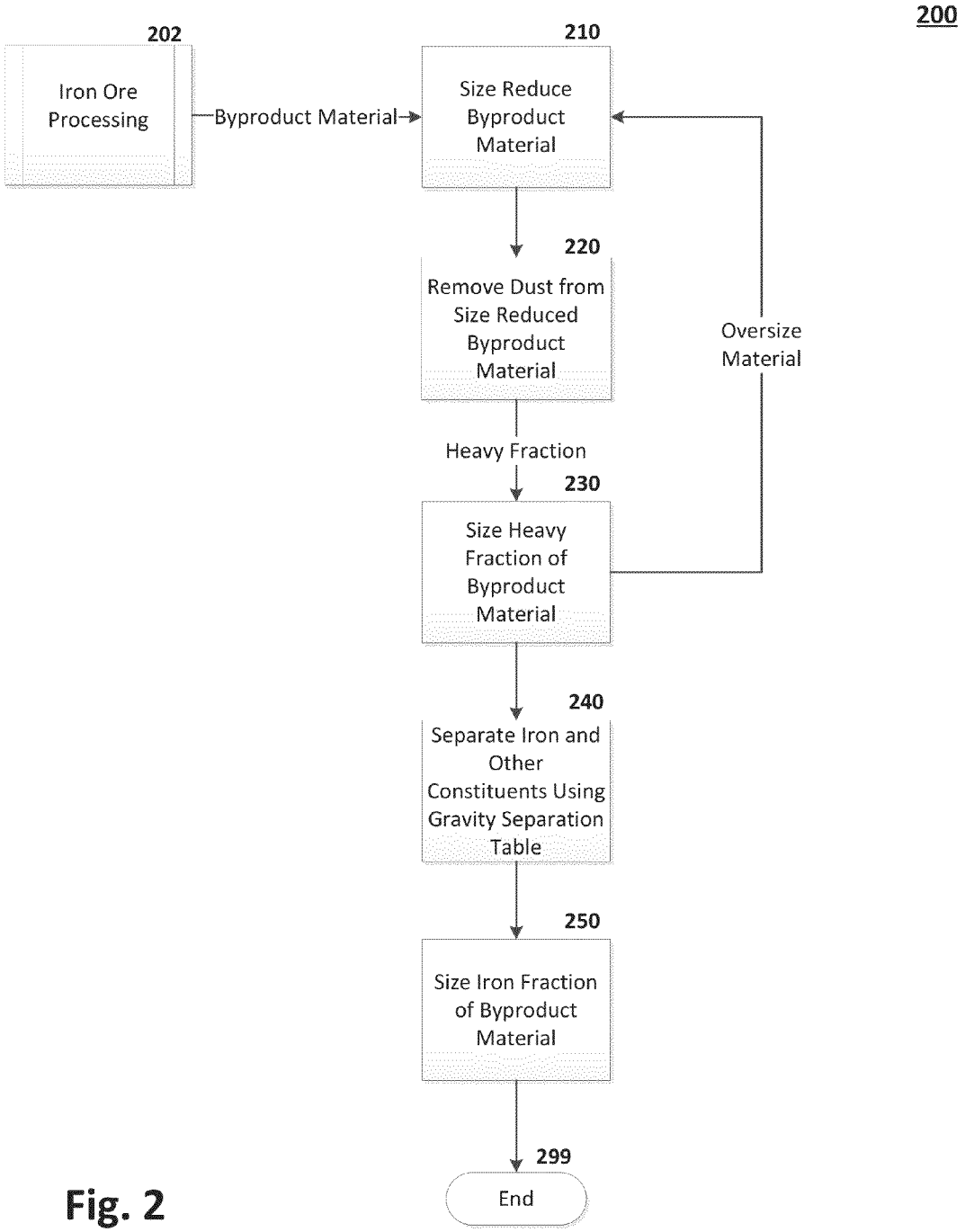
FIG. 2 illustrates an embodiment of a method of iron byproduct processing.

FIG. 2 illustrates an embodiment of a method 200 of iron byproduct processing. It is noted that the process may be practiced using an alternative order of the steps illustrated in FIG. 2 in certain embodiments. That is, the process illustrated in FIG. 2 is provided as an example only, and it may be practiced using flows that differ from that illustrated. Additionally, it is noted that not all steps are required in every embodiment. In other words, one or more of the steps may be omitted or replaced.

In general terms, embodiments of the present invention relate to processing byproducts produced by an iron ore direct reduction process to recover iron and other materials from the byproducts. The processing steps are characterized by the combination, in different possible orders, of four different elements, which are: 1) size reducing the byproducts of the direct reduction process; 2) screening the byproduct material to optimize the performance of gravity separation tables, such performance is directly related to the homogeneity of the size and shape of the particles that the tables process; 3) removing dust from the byproduct material stream by air gravity separation, which also optimizes the performance of gravity separation tables as it reduces clogging of the table screen; and 4) separating the byproduct stream components, including iron, by gravity separation tables that take advantage of the significant differences between the specific weights of the different components constituting the byproduct material without suffering the magnetic interferences that those different elements may feature when exposed to a magnetic separator.

Referring to FIG. 2, at step 210, a byproduct of iron ore processing 202 is size reduced. For example, the one or more size reducers 110 of the processing system 102 described above may be used in step 210. In this exemplary embodiment, the byproduct material is reduced in size to 6 mm or less. In certain embodiments, the byproduct material from the iron ore processing 202 may be sufficiently small as to not require the size reducing step 210 or the desired product, such as anthracite, is preferably kept at a larger size.

At step 220, the byproduct material is introduced into an air aspirator to remove dust from the byproduct material stream. The one or more air aspirators 120 described above may be used in certain embodiments. Step 220 results in two products: a light fraction, which includes the entrained dust and a heavy fraction, which include a "de-dusted" byproduct material stream. The heavy fraction is further processed at step 230. The light fraction is disposed of.

At step 230, the "de-dusted" byproduct material stream is sized. For example, the one or more screens 150 may be used to size the material into a suitable size range. Exemplary size ranges are 6 mm or less. In an alternative embodiment, finer size ranges may be used, such as 0-2 mm, 2-4 mm, 4-6 mm, and greater than 6 mm. Byproduct material that is outside the desired size range, that is, is too large, is returned to the size reducer at step 210. In certain embodiments, an additional size reduction step for the entire "de-dusted" byproduct material stream generated at step 220 may be necessary if a large fraction of the material is outside the desired size range.

At step 240, separate components of the sized byproduct material from step 230 are separated based on the components' specific gravities. The one or more vacuum or pressure gravity separation tables 140 described above may be used at step 240. Based on the separation of the components of the byproduct at step 240, an iron fraction with iron content of about 90% or greater is output. Additionally, other separated elements, such as anthracite, are output based on the separation at step 240. The anthracite may be provided back to other processes, such as iron ore processing 202, as fuel. Any other undesirable elements separated at step 240, such as remaining iron slag of very little iron content, may be disposed of.

At step 250, the iron fraction may be further sized such as be the one or more screens 160 to separate the iron fraction into discrete size ranges. This step may be used to separate different grades of iron ore or may be required based on the minimill specifications for iron ore. The process then ends at step 299.

One of ordinary skill in the art would appreciate that the present invention provides systems and methods for separating iron from the byproduct of a direct reduction process of iron ore. The systems and methods employ gravity separation tables to separate the iron from other byproduct material constituents. The byproduct material constituents may be size reduced, processed to remove dust, and sized prior to processing by the gravity separation.

Although specific embodiments of the invention have been described above in detail, the description is merely for purposes of illustration. It should be appreciated, therefore, that many aspects of the invention were described above by way of example only and are not intended as required or essential elements of the invention unless explicitly stated otherwise. Various modifications of, and equivalent steps corresponding to, the disclosed aspects of the exemplary embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed:

1. A method for separating iron from a byproduct material of a direct reduction process of iron ore comprising the steps of:

receiving the byproduct material of a direct reduction process of iron ore;

processing the byproduct material using an air aspirator to generate a heavy fraction byproduct material and a light fraction byproduct material;

sizing the heavy fraction byproduct material from the air aspirator, wherein the particles comprising the sized heavy fraction byproduct material are within a discrete size range; and separating an iron fraction from the sized heavy fraction byproduct material using a gravity separation table; and sizing the sized heavy fraction byproduct material from the gravity separation table, wherein the iron fraction from the sized heavy fraction byproduct material is not separated using a magnetic separator; the sizing of the sized heavy fraction byproduct material occurs after the separation of the iron fraction from the sized heavy fraction byproduct material using a gravity separation table; and the heavy fraction is separately sized from the sized heavy iron fraction.

2. The method of claim 1 further comprising the step of size reducing the received byproduct material.

3. The method of claim 2 wherein the size reducing step is performed by a crusher.

4. The method of claim 1 wherein the gravity separation table is a pressure-type gravity separation table.

5. The method of claim 1 further comprising the step of sizing the iron fraction.

6. The method of claim 1 wherein heavy fraction byproduct material comprising particles greater than the discrete size range are further size reduced.

7. A system for separating iron from a byproduct material of a direct reduction process of iron ore comprising:

a source of the byproduct material of a direct reduction process of iron ore, wherein the material has less than about 10% magnetic iron by weight;

a crusher for sizing the byproduct material;

an air aspirator for processing the byproduct material to generate a heavy fraction byproduct material and a light fraction byproduct material;

a first screen for sizing the heavy fraction byproduct material from the air aspirator, wherein the particles comprising the sized heavy fraction byproduct material are within a discrete size range; and a gravity separation table for separating an iron fraction from the sized heavy fraction byproduct material using; and a second screen for sizing the sized heavy fraction byproduct material from the gravity separation table;

wherein the system does not include a magnetic separator; the first screen receives the heavy fraction byproduct material from the air aspirator; and the second screen receives the iron fraction from the gravity separation table.

8. The system of claim 7 further comprising a crusher size reducing the byproduct material.

9. The system of claim 7 wherein the gravity separation table is a pressure-type gravity separation table.

10. The system of claim 7 wherein the gravity separation table is a vacuum-type gravity separation table.

11. The system of claim 7 further comprising a second screen for sizing the iron fraction.

12. The method of claim 1, wherein the iron fraction from the sized heavy fraction byproduct material is not separated using a magnetic separator.

13. The system of claim 7, wherein the system does not include a magnetic separator.

14. The method of claim 1, wherein the iron fraction is reduced to a size less than 6 mm.

15. A method for separating iron from a byproduct material of a direct reduction process of iron ore comprising the steps of:

receiving the byproduct material of a direct reduction process of iron ore, wherein the material has less than about 10% magnetic iron by weight;

crushing the byproduct material to a size less of 6 mm;

processing the byproduct material using an air aspirator to generate a heavy fraction byproduct material and a light fraction byproduct material;

sizing the heavy fraction byproduct material from the air aspirator, wherein the particles comprising the sized heavy fraction byproduct material are within a discrete size range of about 2 mm; and separating an iron fraction from the sized heavy fraction byproduct material using a gravity separation table; and sizing the sized heavy fraction byproduct material, wherein the iron fraction from the sized heavy fraction byproduct material is not separated using a magnetic separator; and the sizing of the heavy faction byproduct material occurs after to the separation of the iron fraction from the sized heavy fraction byproduct material using a gravity separation table.

16. The method of claim 1, wherein the discrete size range is about 2 mm.

17. The method of claim 15, wherein the discrete size range is about 2 mm.

18. The method of claim 1, wherein the material has less than about 10% magnetic iron by weight.

19. The method of claim 1, wherein the crusher sizes the byproduct material to a size less of 6 mm.

* * * * *